US005244369A

United States Patent [19]

Miller et al.

[11] Patent Number: 5,244,369

[45] Date of Patent: Sep. 14, 1993

[54] LIQUID METAL ATOMIZATION NOZZLE WITH INTEGRAL VIEWING SYSTEM

[75] Inventors: Steven A. Miller, Amsterdam; Russell S. Miller, Ballston Spa, both of N.Y.

[73] Assignee: General Electric Company, Schenectady, N.Y.

[21] Appl. No.: 997,752

[22] Filed: Dec. 30, 1992

[51] Int. Cl.[5] ..... B22F 9/08

[52] U.S. Cl. ..... 425/7; 75/338; 264/12; 359/509; 359/894

[58] Field of Search ..... 425/6, 7; 264/12; 75/358, 339, 335; 65/5, 16; 359/509, 894; 250/330, 340, 341

[56] References Cited

U.S. PATENT DOCUMENTS

| | | | |
|---|---|---|---|
| 1,356,780 | 10/1920 | Nicol | 75/338 |
| 3,170,383 | 2/1965 | Hunt | 454/370 |
| 3,692,443 | 9/1972 | Lightner | 425/7 |
| 3,696,230 | 10/1972 | Friedrich | 219/121.75 |
| 4,277,131 | 7/1981 | Hart et al. | 359/509 |
| 4,488,032 | 12/1984 | Case, Jr. et al. | 219/124.34 |
| 4,738,528 | 4/1988 | Craft | 356/43 |
| 4,784,491 | 11/1988 | Penney et al. | 356/376 |

OTHER PUBLICATIONS

"Real-Time Particle Size Analysis During Inert Gas Atomization", F. Biancaniello, C. Presser and S. D. Ridder, Materials Science and Engineering, A124 (1990), pp. 21-29.

*Primary Examiner*—Jay H. Woo
*Assistant Examiner*—Joseph Leyson
*Attorney, Agent, or Firm*—James E. McGinness; James Magee, Jr.

[57] ABSTRACT

An apparatus for viewing the atomization of liquid metal is disclosed. A nozzle for atomizing liquid metal having a cylindrical plenum, and a melt guide tube extending axially therethrough to a melt exit orifice. The plenum defines an inner chamber coupled with an atomizing gas orifice spaced from the exit orifice and configured to provide an annular jet of atomizing gas converging in an atomizing zone extending below the exit orifice The plenum having an inner sidewall and an outer sidewall defining the inner chamber therebetween. The inner sidewall extends below the exit orifice so that the inner sidewall is spaced from the atomizing zone. A cylindrical sleeve extends through the outer sidewall to a first end in the inner chamber. A camera mounted in the sleeve has a field of view extending from the first end. A transparent window is mounted to seal the first end. The sleeve is positioned so the field of view extends through the atomization zone. A porthole extends through the inner sidewall along the field of view to provide a view of the atomization zone to the camera, and for a gas flow therefrom.

25 Claims, 5 Drawing Sheets

LIQUID METAL ATOMIZATION NOZZLE WITH INTEGRAL VIEWING SYSTEM

This application is related to concurrently filed applications Ser. No. 07/997,740, filed on Dec. 30, 1992, Ser. No. 07,997,742, filed on Dec. 30, 1992, and Ser. No. 07/997,743, filed on Dec. 30, 1992.

This invention relates to an apparatus for viewing the atomization of liquid metal.

BACKGROUND OF THE INVENTION

Close coupled gas atomization of liquid metal is being developed as a process for forming metal powders. In close coupled gas atomization, a cylindrical gas plenum having an inner chamber in communication with an annular orifice, or an annular array of discrete orifices produce a jet, which may be comprised of an array of jets, that converge below a melt guide tube extending axially through the gas plenum. A stream of liquid metal passing through the melt guide tube and exiting therefrom is atomized in the annular jet of atomizing gas converging in the stream.

When the gas atomization of liquid metal is commenced, there is an opportunity to view the atomization of the liquid metal from viewports in the atomization chamber. In the atomization process, the atomizing gas flows at supersonic speeds resulting in great scattering and recirculation of the particulate formed by the atomization process. Soon after the atomization starts producing powdered material, recirculating powder from the atomization process obscures the view. In fact, the observation of the atomization nozzle is obscured within seconds after the process is started.

Information regarding the nature of the interaction between the atomizing gas and the liquid metal at the atomization nozzle can be obtained immediately at the start of the atomization process and before the viewing path to the atomization nozzle is obscured by the recirculating powder produced by the atomization process. However, it has not been possible to view the atomization process for more than a few seconds after the atomization has begun. The ability to observe the atomization process that occurs in a zone below the nozzle tip is lost. Loss of this information is well recognized as being a major impediment to the successful adaption of control devices and strategies to provide process control. It is highly desirable to be able to observe the atomization at the atomization nozzle, and in the atomization zone below the nozzle over an extended period of time to provide process control.

Several important properties of metal powder, and the products formed from consolidation of the powder, are dependent on the as-atomized particle size. These properties include composition homogeneity, mechanical performance, e.g. strength, and toughness, as well as physical characteristics of the powder itself, e.g., particle shape, porosity, and flow qualities. Most of these properties improve as particle size decreases, however, powder handling becomes more complicated for finer powder because of caking, environmental contamination, pyrophorosity and other affects.

The strong dependence of properties on particle size translates into an increased demand for atomization process control that provides a predetermined particle size range, and minimizes the production of powder having a particle size above or below the predetermined range. Such process control can be improved by viewing the interaction of the atomizing gas jet and the liquid metal stream in the atomization zone.

An aspect of this invention is to provide an apparatus for viewing the atomization of liquid metal.

BRIEF DESCRIPTION OF THE INVENTION

A viewing apparatus for liquid metal atomization is comprised of a nozzle for atomizing liquid metal. The nozzle is comprised of a cylindrical plenum means, and a melt guide tube extending axially therethrough to a melt exit orifice. The plenum means defines an inner chamber coupled with an atomizing gas orifice spaced from the exit orifice and configured to provide an annular jet of atomizing gas converging in an atomizing zone extending below the exit orifice. A first gas inlet extends through the plenum means to provide atomizing gas to the inner chamber.

The plenum means is comprised of an inner sidewall and an outer sidewall defining the inner chamber therebetween. The inner sidewall extends below the exit orifice so that the inner sidewall is spaced from the atomizing zone. A cylindrical sleeve extends through the outer sidewall to a first end in the inner chamber. A camera mounted in the sleeve has a field of view extending from the first end, and a transparent window is mounted to seal the first end. The sleeve is positioned so the field of view of the camera extends through the atomization zone. A porthole means extends through the inner sidewall along the field of view to provide a view of the atomization zone to the camera, and for a gas flow therefrom.

BRIEF DESCRIPTION OF THE DRAWINGS

The following description of the invention will be understood with greater clarity if reference is made to the following drawings.

DETAILED DESCRIPTION OF THE INVENTION

We have found that the atomized metal droplets formed by the close coupled atomization nozzle form a finite plume. In addition, we have discovered that the viewing apparatus of this invention can be positioned adjacent the plume with a view of the atomization zone, without intruding into the plume As a result, the apparatus of this invention can provide a view of the atomization zone during the atomization process despite the recirculating particles in the atomization enclosure.

Figure 1:
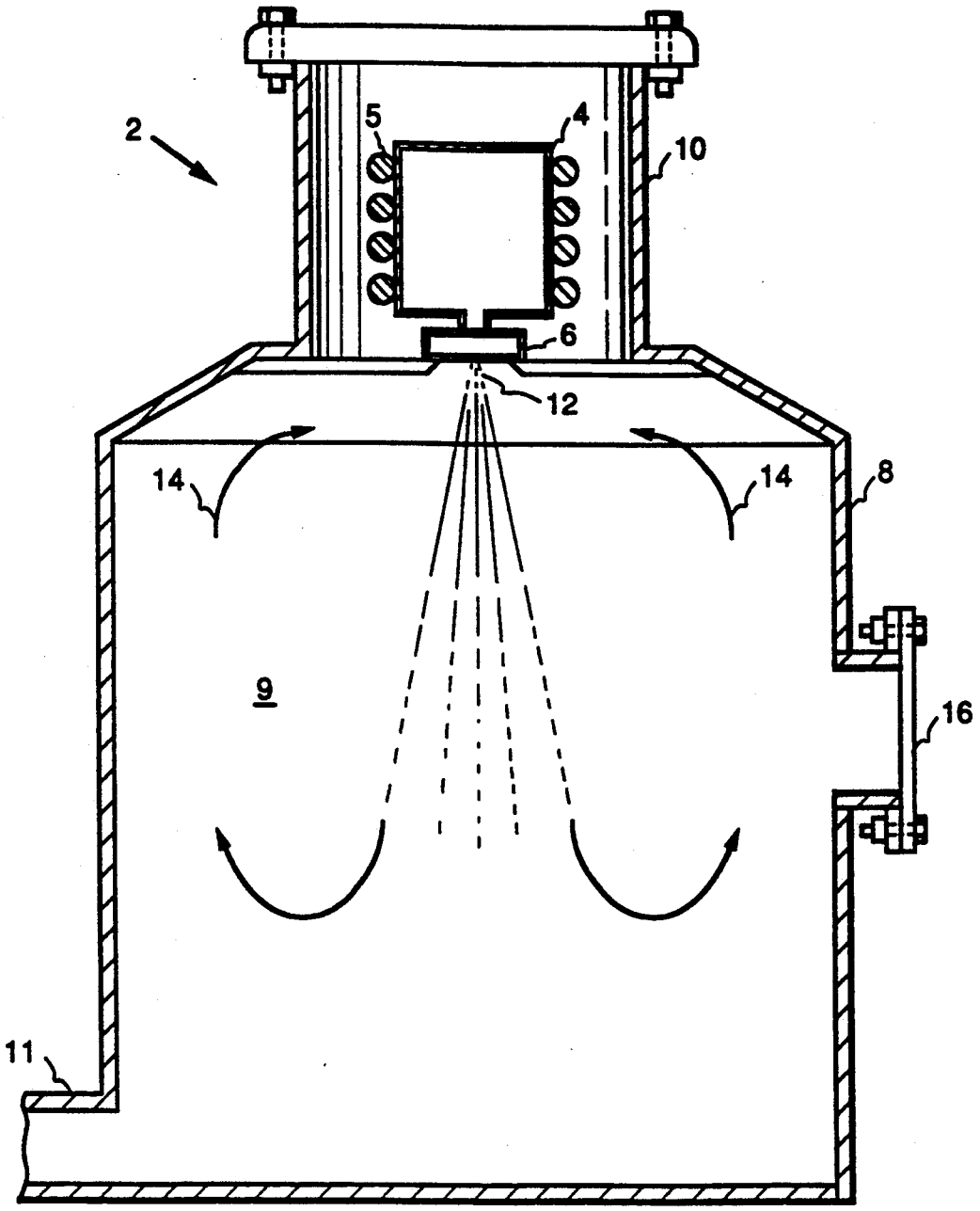
FIG. 1 is a schematic side view of an apparatus of atomizing molten metal.

Referring to FIG. 1, an apparatus 2 for atomizing liquid metal is shown. The apparatus 2 is at least comprised of a crucible 4, a nozzle 6, and an enclosure 8. The crucible 4 is formed of suitable material for holding the liquid metal, e.g. ceramic such as alumina or zirconia, or water cooled copper. A conventional heating means such as element 5 can be positioned for heating the molten metal therein. The molten metal in crucible 4 can be heated by any suitable means, such as an induction coil, plasma arc melting torch, or a resistance heating coil. The crucible 4 has a bottom pouring orifice coupled with a melt guide tube in nozzle 6. The crucible 4, and nozzle 6 are conventionally mounted on atomization enclosure 8.

The atomization enclosure 8, formed from a suitable steel, is configured to provide an inner chamber 9 suitable for containing the atomization process. Depending upon the metal being atomized, enclosure 8 can contain an inert atmosphere or vacuum. A suitable crucible enclosure 10 can be formed over the crucible 4 to contain an inert atmosphere for the liquid metal. A conventional vacuum pump system, not shown, or gas supply means, not shown, are coupled with atomization enclosure 8 and crucible enclosure 10 to provide the inert atmosphere or vacuum therein. A conventional exhaust system, not shown, for example with cyclone separators, is coupled with enclosure 8 at connection 11 to remove the atomized powder during the atomization process.

A stream of liquid metal from crucible 4 is atomized by nozzle 6, forming a plume of molten metal droplets 12 which are rapidly quenched to form solid particulates of the metal. Suitable nozzles are shown, for example, in U.S. Pat. Nos. 4,801,412, 4,780,130, 4,778,516, 4,631,013, and 4,619,845, and patent applications Ser. No. 07/920,075, and Ser. No. 07/928,385, each incorporated herein by reference. The nozzle 6 directs a stream of liquid metal into an annular converging supersonic jet of atomizing gas. The annular jet of gas may be comprised of an array of jets issuing from an annular array of discrete orifices, or a single continuous jet issuing from an annular orifice.

The high kinetic energy of the supersonic atomizing gas jet breaks up the stream of liquid metal into atomized droplets which are widely dispersed from recirculation of the atomizing gas in the atomization enclosure. As a result, in a short period of time, within several seconds of the initiation of atomization, the atomization vessel is filled with a cloud of recirculating powder particulates, for example shown by arrows 14. While atomization of the liquid metal stream can be viewed at the initiation of atomization, for example from view port 16 mounted on atomization enclosure 8, the view is obscured by the cloud of metal particulates within a few seconds.

Figure 2:
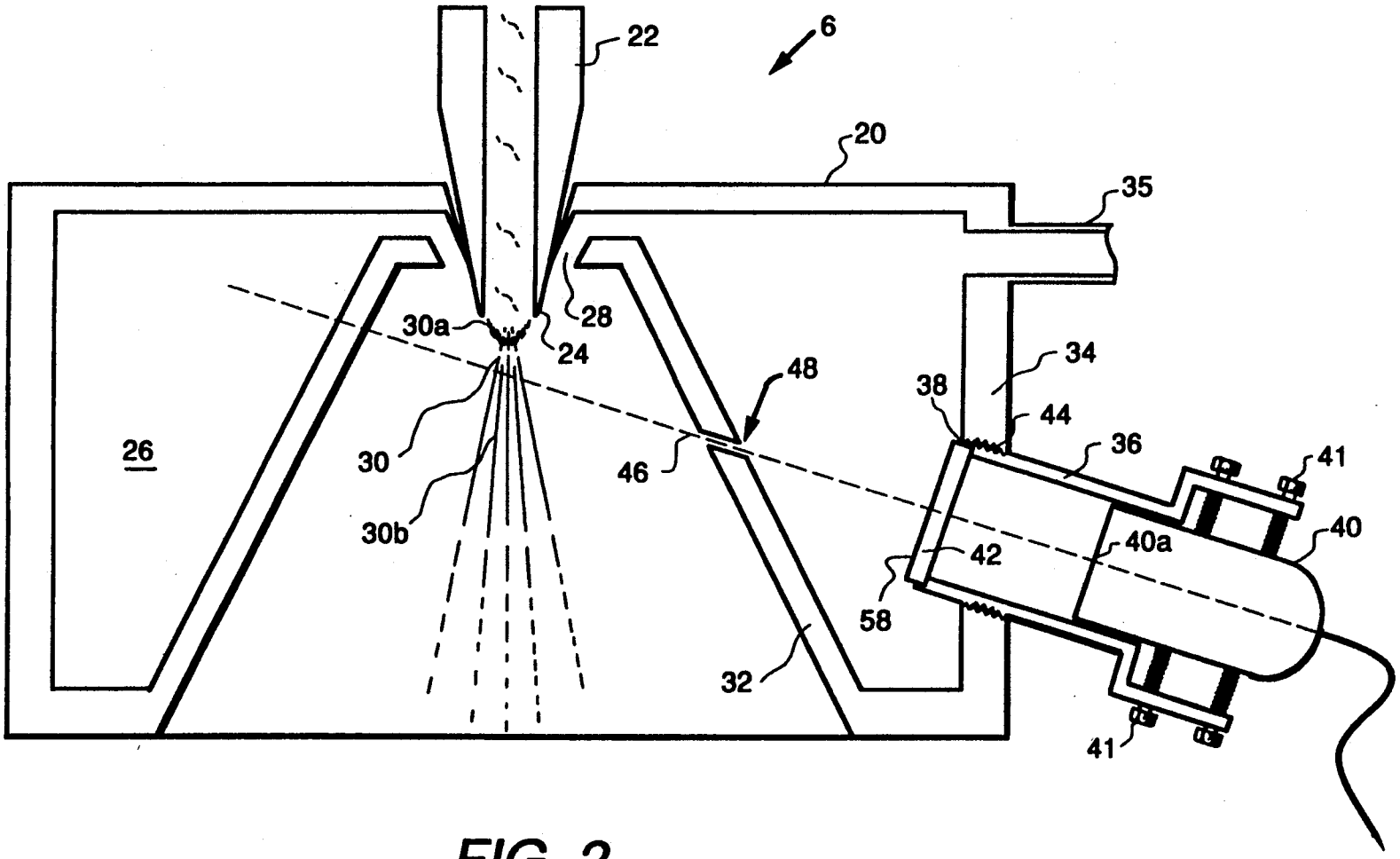
FIGS. 2-5 are schematic side views of a viewing means formed as an integral part of an atomization nozzle.

The viewing apparatus of this invention is shown by referring to FIG. 2. The nozzle 6 is comprised of a cylindrical plenum means 20, and a melt guide tube 22 extending axially therethrough to a melt exit orifice 24. The melt delivery tube 22 extends from the bottom pouring orifice in the crucible, not shown. The plenum means 20 defines an inner chamber 26 coupled with an annular atomizing gas orifice 28 spaced from the exit orifice 24 and configured to provide an annular jet of atomizing gas converging in an atomizing zone 30 extending from the exit orifice 24. The plenum means 20 is configured with a cylindrical inner sidewall 32 extending below the exit orifice 24 and spaced from the atomizing zone 30. The inner sidewall 32 extends to a cylindrical outer sidewall 34. The inner sidewall 32 can be adjustably mounted on the outer sidewall 34, for example, by providing mating threaded surfaces (not shown) where the inner sidewall meets the outer sidewall. A gas inlet tube 35 extends through the outer sidewall 34, and is coupled with a conventional gas supply means, not shown, to provide a predetermined atomizing gas pressure in inner chamber 26.

As used herein, the term "atomization zone" includes the exit orifice 24 at the tip of the melt guide tube 22 and extends therefrom, for example, for a distance of up to 20 exit orifice diameters. The atomization zone typically includes a first section 30*a* where the stream of liquid metal extends from the exit orifice 24. In a second section 30*b*, the liquid metal stream interacts with the gas jet emitted from the atomization gas orifice 28, and the stream breaks up or atomizes.

A cylindrical sleeve 36 extends through the outer sidewall 34 to a first end 38 in communication with the inner chamber 26. A camera 40 is mounted by conventional fasteners 41 in the sleeve to have a field of view extending from the first end 38. Preferably, the camera is mounted in the sleeve with a low thermal conductivity insulating material, such as nylon, therebetween. For example, the fasteners 41 can be formed from the insulating material. The sleeve 36 is positioned so that the field of view of the camera 40 can extend through the the atomization zone 30. Preferably, the sleeve 36 has a threaded exterior surface mating with a threaded bore 44 in outer sidewall 34.

A transparent window 42 is mounted to seal the first end 38 of the sleeve 36. The window 42 is formed from a transparent material such as silica glass, Lucalox polycrystalline alumina, polycrystalline yttria U.S. Pat. No. 4,755,492, or single crystal alumina or zirconia. Conventional lensing for the camera 40 can be positioned at a front end 40*a* of the camera, or the transparent window 42 can be formed as the lensing for the camera. Suitable conventional lenses, known as microminiature lenses, are, for example, Toshiba models JK-L04, JK-L7.5, JK-L15, and JK-L24.

A porthole means 48 is formed in the inner wall 32 along the field of view of camera 40 to provide a view of the atomization zone through the inner wall 32. For example, the porthole means 48 can be formed as a bore 48 in the inner sidewall 32 along the field of view of camera 40 to provide a view of the atomization zone 30 to camera 40. Atomizing gas at a high pressure in chamber 26 flows from the porthole means 48, and interacts with recirculating powder particles that can be directed down the porthole means. The flow or jet of gas emitted from the porthole means blows the powder particles back out of the porthole means before the powder can reach the transparent window 42. The flow or jet of gas from the porthole means prevents powder from contaminating, e.g., pitting, scratching, or depositing on the transparent window 42.

The bore 48 is at least large enough to admit sufficient light to the camera 40 to generate an image of the atomization zone. However, the bore is restricted in size so that the purging gas jet issuing therefrom does not substantially disturb the atomization process For example, a suitable size for the bore 48 in the inner sidewall 32 was found to be about 0.25 to 4 millimeters.

Figure 3:
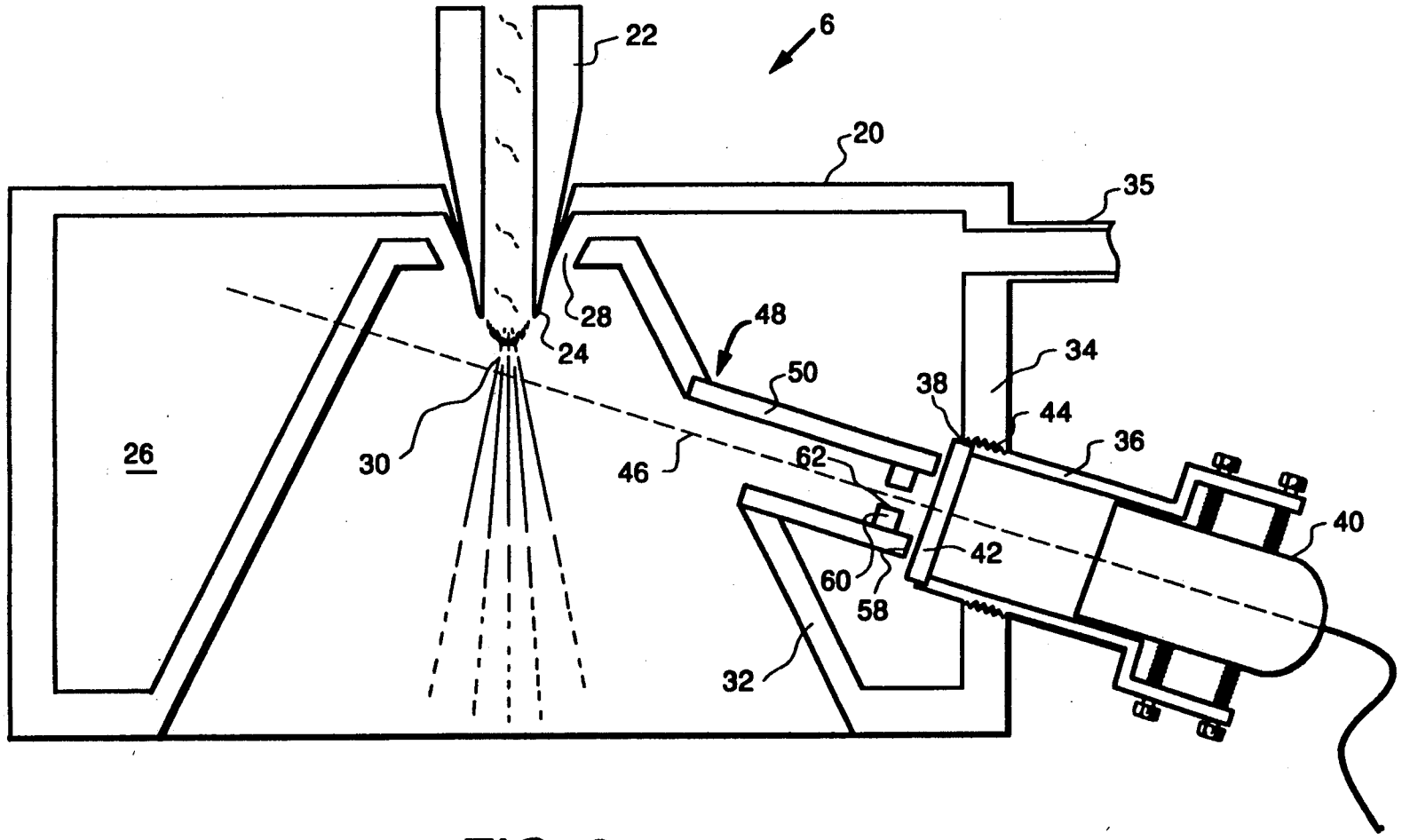

Referring to FIG. 3, another porthole means 48 extends through the inner wall 32 along the field of view of camera 40 to provide a view of the atomization zone 30 through the inner wall 32. For example, the porthole means 48 can be comprised of a first sleeve 50 extending through the inner wall 32 to a second end 58 spaced from the transparent window 42. A disk 60 having an axial bore 62 is mounted in the first sleeve 50. The bore 62 is sufficient to provide a view of the atomization zone 30 to camera 40. In addition, the high pressure atomizing gas within the chamber 26 flows through the bore 62 to provide a purging gas jet flowing out of the porthole means 48 toward the atomization zone 30. The purging gas jet minimizes the intrusion of atomized particles into the chamber 26, and prevents contact or deposit of the particles on the window 42.

The gap between the second end 58 of the first sleeve 50, and the first end 38, or window 42, can be selectively adjusted, because the threaded outer surface of sleeve 36 provides for axial positioning of the sleeve. For example, a preselected gap can be chosen to restrict the gas flow through the first sleeve 50 and the bore 62. As a result, larger bores can be formed, for example, the bore 62 can have a diameter of about 0.25 to 13 millimeters. Preferably, when the bore 62 is greater than about 4 millimeters, the gap between the second end 58 and the window 42 is selectively adjusted to provide a gas flow through the bore 62 that does not substantially disturb or interfere with the atomization process.

Figure 4:
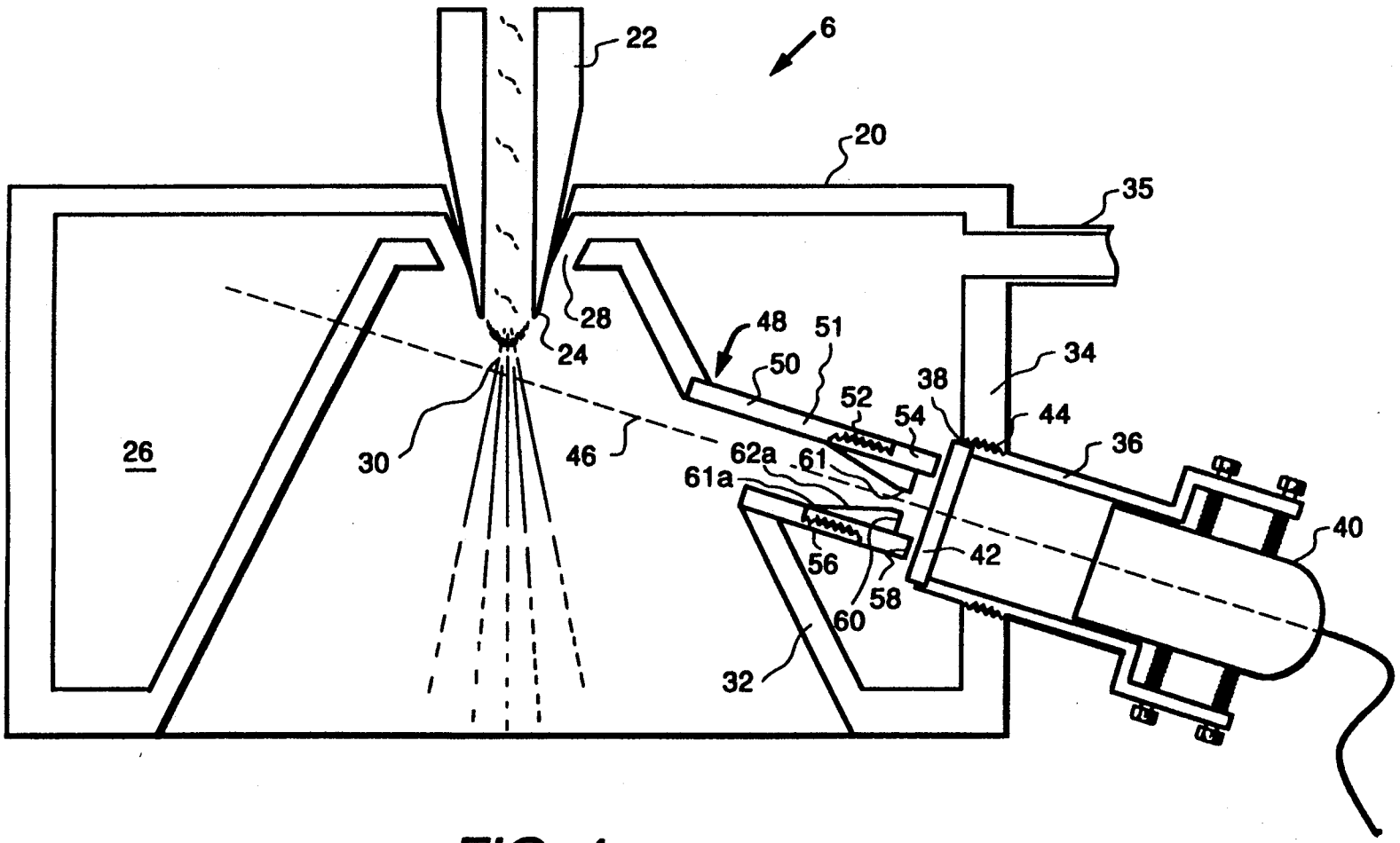

Referring to FIG. 4, the first sleeve 50 can be comprised of a first section 51 extending to a first threaded end 52. A second section 54 having a second threaded end 56 mating with the first threaded end 52 extends to the second end 58 spaced from the transparent window 42. The disk means 60 mounted in the first sleeve 50 is preferably formed with a frustrum shaped axial bore **62*a* having a narrow end 61 facing the window 42. Preferably, the frustrum shaped bore 62*a* has an included angle of about 10 to 40 degrees. In other words, if the frustrum is extended to form a cone, the apex angle of the cone can range from about 10 to 40 degrees. Included angles of greater than about 30 to 40 degrees, can exceed the maximum expansion angle of the gas jet passing through the frustrum shaped bore. When the maximum expansion angle of the gas jet is exceeded, recirculating gas currents can form in the bore that draw the recirculating particles toward the window 42**.

In this way, the gas pressure in the frustrum shaped bore **62*a* is greatest at the narrow end 61 and decreases towards the wider end 61*a*. Atomized particles entering the frustrum shaped bore 62*a* meet greater and greater resistance as the particles proceed toward the narrow end 61. The gas flow or jet through the frustrum shaped bore, protects the transparent window 42 from atomized particles depositing on, scratching, or otherwise damaging the window. The narrow end 61 of the frustrum shaped bore 62*a* can have a diameter of about 0.25 to 13 millimeters. When the narrow end 61 is less than about 0.25 millimeters in diameter, insufficient light is admitted for the camera 40 to form an image. When the narrow end 61 is greater than about 13 millimeters in diameter, the gas jet from the frustrum shaped bore can become massive enough to disturb the atomization process. Preferably, when the narrow end 61 is greater than about 4 millimeters, the gap between the second end 58 and the window 42 is selectively adjusted to provide a gas flow through the bore 62** that does not substantially disturb or interfere with the atomization process.

Referring to FIGS. 3 and 4, the mating threaded ends of first section 51 and second section 54 provide for axial adjustment and extension of second end 58 into chamber 26. Similarly, the threaded exterior of sleeve 36 mating with threaded bore 44 in the outer sidewall 34 provides for axial adjustment of the sleeve to provide for adjustment of the gap between transparent window 42, and third end 58. As a result, a preselected spacing or gap between second end 58 and transparent window 42 can be selected to provide a flow of gas from within the inner chamber 26 through the bore 62 and out of sleeve 50 that minimizes the passage of atomized particles through the porthole means, and depositing on or scratching transparent window 42. The gap can also be selectively adjusted to provide a gas flow that does not substantially disturb the atomization process.

For example, when the bore 62, or the narrow end 61 of the frustrum shaped bore, is closer to the maximum diameter, preferably, the preselect spacing is selected to control the gas flow through the bore so that the purging gas jet does not substantially disturb the atomization process.

Additional control over the purging gas jet issuing from the porthole means can be achieved by forming the plenum means to define two separate inner chambers. A first inner chamber in communication with the atomizing gas orifice, and a second inner chamber in communication with the porthole means. A first gas inlet extends through the plenum means in communication with the first chamber, and a second gas inlet extends through the plenum means in communication with the second chamber. The first and second gas inlet each being operatively coupled to a conventional gas supply means to provide the atomizing gas and purging gas, respectively.

Figure 5:
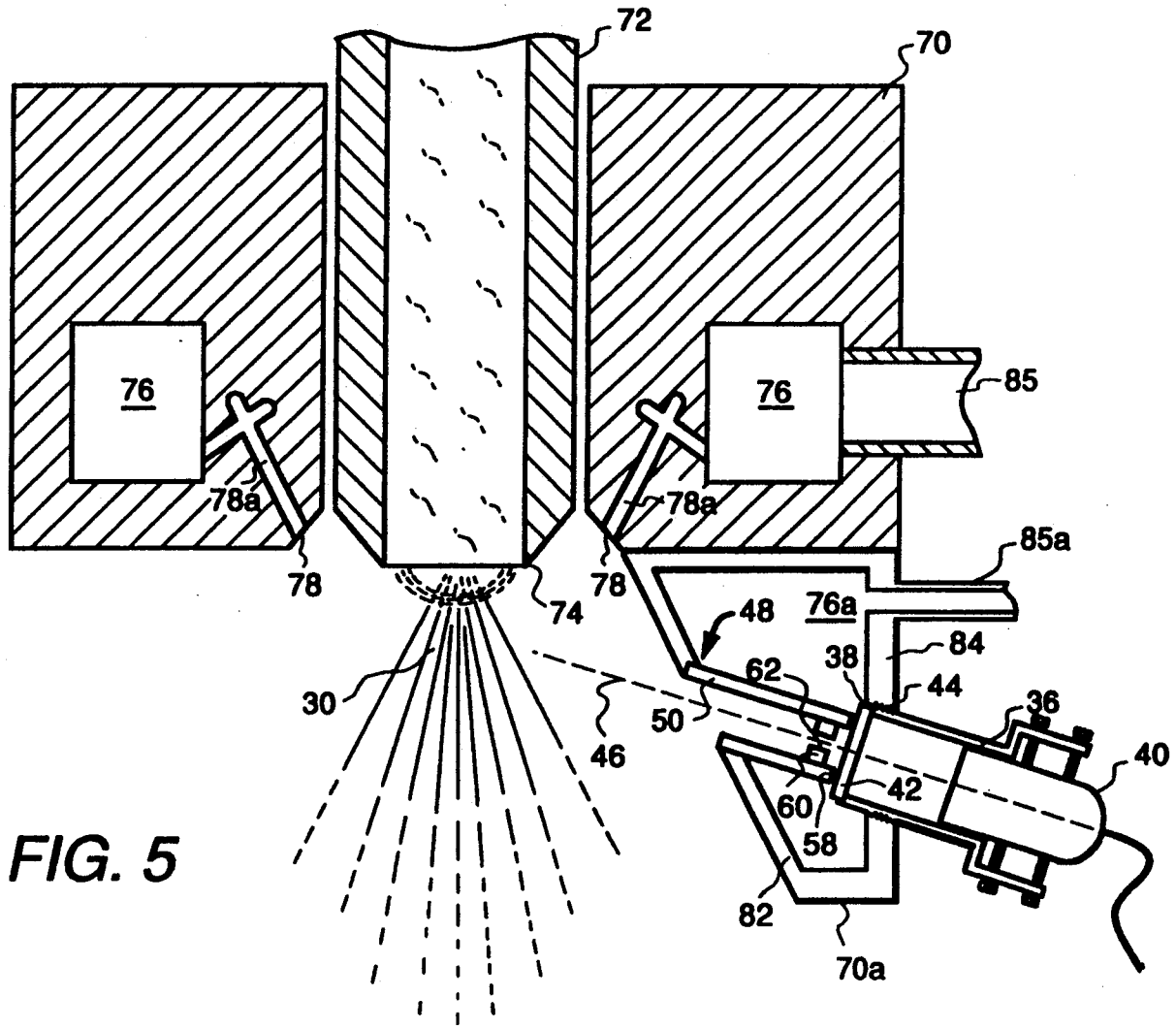

Another viewing apparatus of this invention is shown by referring to FIG. 5. FIG. 5 shows an atomizing nozzle having a viewing means mounted thereon. Some elements commonly shown in FIGS. 2–4 are shown with the same number, while similar elements are shown with a number increased by 50.

The nozzle is comprised of a cylindrical first plenum means 70 and a melt guide tube 72 extending axially therethrough to a melt exit orifice 74. The first plenum means 70 defines an inner chamber 76 coupled with an annular array of discrete atomizing gas orifices 78 spaced from the exit orifice 74 and configured to provide an annular gas jet comprised of an array of discrete atomizing gas jets converging in an atomizing zone 30 extending from the exit orifice 74. Individual channels **78*a* provide the communication between the chamber 76 and the orifices 78. A first gas inlet 85 extends through the first plenum means 70 in communication with the inner chamber 76** to provide atomizing gas to the inner chamber.

A second plenum means **70*a* is conventionally mounted on the first plenum means 70 for example by welding. The second plenum means is comprised of an inner sidewall 82 and an outer sidewall 84 defining a second inner chamber 76*a*. The inner sidewall 82 extends below the exit orifice 74 so that the inner sidewall is spaced from the atomizing zone 30. A second gas inlet 85*a* extends through the second plenum means 70*a* in communication with the second inner chamber 76*a*. The second gas inlet 85*a* is operatively connected to a conventional gas supply means, not shown, to provide a purging gas inert to the atomized liquid metal, such as argon. The second plenum 70*a* can be formed as a section large enough to contain the cylindrical sleeve 36, shown in FIG. 5, or may be formed as a cylindrical plenum extending from the first plenum 70**.

The cylindrical sleeve 36 extends through the outer sidewall 84 to the first end 38 in the second inner chamber **76*a*. The camera 40 is mounted in the sleeve to have the field of view 46 extending from the first end 38. The transparent window 42 is mounted to seal the first end 38. The sleeve 36 being positioned so the field of view 46 extends through the atomization zone 30. The port hole means 48 extends through the inner sidewall 82 along the field of view to provide the view of the atomization zone to the camera 40 and for a gas flow therefrom. The porthole 25 means 48 can be formed as shown in FIGS. 2–4, i.e., as a bore in the inner sidewall 82, or as the first sleeve 50 extending through the inner sidewall 82 to the second end 58 spaced from the transparent window 42**.

The disk 60 having an axial bore 62 is mounted in the sleeve 50. The bore 62 is sufficient to provide a view of the atomization zone 30 to the camera 40. The high pressure purging gas provided within second chamber 76a flows through the bore 62 to provide a purging gas jet flowing out of the porthole means 48 toward the atomization zone 30. The purging gas jet minimizes the intrusion of atomized particles into the second chamber 76a and prevents contact or deposit of the particles on the window 42. It should be understood that the first sleeve 50 can be comprised of the first and second sections coupled to mating threaded ends as described above and shown in FIG. 4. In addition, the disk means 60 can be formed with a frustrum shaped axial bore having a narrow end facing the window 42 as described above and shown in FIG. 4.

When the ratio of the gas pressure P* in the second inner chamber 76a to the ambient pressure P is greater than about 2 to 3 a supersonic gas jet is formed in the frustrum shaped bore. It is well known that the index of refraction along an optical path, such as the field of view extending through the bore, can change due to variations in gas density. Such changes in the index of refraction can optically distort the light entering the camera. As a result, the amount of distortion can increase with increased gas density and density gradients, for example produced in a supersonic gas jet. It is believed distortion will be minimal in subsonic gas jets, while distortion can increase above supersonic velocities.

Preferably, the purging gas, such as argon, is supplied to the second inner chamber 76a at a pressure sufficient to provide purging gas velocities in the bore that prevent particles from damaging the window, and provide a clear field of view. However, some distortion in the image provided by the camera could be observed as the gas pressure to the second inner chamber 76a is increased, and the purging flow in the bore exceeded the sonic velocities. When the gas flow remains attached to the sidewalls of the bore, for example in the frustrum shaped bore having an included angle of 10 to 40 degrees, the gas density gradients in the bore are minimized. Therefore, the frustrum shaped bore is preferred when higher gas velocities, e.g., sonic velocities are required.

A suitable purging gas velocity will depend upon the particular atomization process. For example, a suitable purging gas velocity can be determined by increasing the pressure supplied to the second inner chamber 76a to an upper pressure limit where the image from the camera becomes distorted from the variations in gas density and gas flow gradients in the bore and first sleeve. The atomization process is activated to atomize a molten metal, and the pressure supplied to the second inner chamber 76a is reduced to a lower pressure limit where recirculating powder is visible in the image from the camera. The purging gas is provided to the second inner chamber 76a at a pressure between the upper and lower pressure limits.

Camera 40 is preferably what is known as a microminiature camera. Microminiature cameras have been developed and marketed by such companies as Toshiba, Sony, and Pulnix. The preferred commercially available cameras are miniature CCD based S-VHS or VHS cameras incorporating high speed electronic shutters. Examples of such commercially available cameras are the Toshiba IK-C30MA and IK-M30MA, and the Sony XC-77RR and XC-77RRCE. Such cameras can have a diameter of 3 centimeters or less, and a length of about 2 to 3 centimeters or less complete with the associated lensing. As a result, it is possible to fit these cameras into a small space and protect them from the atomization environment, something not practical with typical video cameras The camera may be formed as an imaging pyrometer, for example shown in U.S. Pat. Nos. 4,687,344, or 4,656,331 to provide a temperature profile of the atomization zone with an associated visual image.

However, like all solid state devices, the cameras are operated within a limited temperature range. Preferably, a cooling means provides a cooling gas to prevent overheating of the camera from the hot recirculating atomization gas. The cooling means can be mounted in the sleeve to provide additional cooling for the camera and associated electrical connection cord. For example, a suitable shielding conduit extends from the sleeve 36 to enclose and protect any portion of the camera and the camera cord extending from the sleeve. A tube extending through the shielding conduit and into sleeve 36 is coupled with a conventional gas supply means to provide a suitable cooling gas such as argon. Alternatively, a channel, not shown can be formed in the plenum means to provide for the flow of gas therefrom onto the sleeve and around the camera. The required gas flow for adequate cooling is determined by the operating conditions and design of the plenum as well as the properties of the alloy to be atomized. Preferably, the camera lens and body are maintained at about −5° to 40° C.

The camera provides an output signal, such as the standard EIA RS-170 composite signal (525 line, 60 Hz, 2/1 interlace) through the camera cord. The output signal can be sent to a signal processor, not shown. At the signal processor the signal can be split and sent to a conventional video recorder and television display as well as being digitized and sent to a computer control.

What is claimed is:

1. A viewing apparatus for liquid metal atomization comprising;

a nozzle for atomizing liquid metal comprised of a cylindrical plenum means, and a melt guide tube extending axially therethrough to a melt exit orifice, the plenum means defining an inner chamber coupled with an atomizing gas orifice spaced from the exit orifice and configured to provide an annular jet of atomizing gas converging in an atomizing zone extending from the exit orifice, a first gas inlet extending through the plenum means to provide atomizing gas to the inner chamber, the plenum means being comprised of an inner sidewall and an outer sidewall defining the inner chamber therebetween, the inner sidewall extending below the exit orifice so that the inner sidewall is spaced from the atomizing zone, a cylindrical sleeve extending through the outer sidewall to a first end in the inner chamber, a camera mounted in the sleeve having a field of view extending from the first end, and a transparent window mounted to seal the first end, the sleeve being positioned so the field of view extends through the atomization zone, and a porthole means extending through the inner sidewall along the field of view to provide a view of the atomization zone to the camera, and for a gas flow therefrom.

2. The apparatus of claim 1 wherein the porthole means is comprised of a first sleeve extending through the inner wall to a second end spaced from the transparent window, and a disc mounted in the first sleeve, the disc having a bore that the field of view extends through.

3. The apparatus of claim 2 wherein the bore is about 0.25 to 4 millimeters in diameter.

4. The apparatus of claim 2 wherein the cylindrical sleeve has a threaded outer surface mating with a threaded bore in the outer sidewall.

5. The apparatus of claim 2 wherein the bore is shaped as a frustrum having a narrow end facing the window.

6. The apparatus of claim 5 wherein the narrow end has a diameter of about 0.25 to 13 millimeters.

7. The apparatus of claim 5 wherein the frustrum has an included angle of about 10 to 40 degrees.

8. The apparatus of claim 2 wherein the first sleeve is comprised of a first section extending through the inner wall to a first threaded end, and a second section having a second threaded end mating with the first threaded end, the second secton extending therefrom to the second end, wherein the second end is spaced a preselected distance from the transparent window to provide a gas flow through the bore that minimizes passage of atomized particles to the window.

9. The apparatus of claim 1 wherein the camera is an imaging pyrometer.

10. The apparatus of claim 1 wherein the camera is mounted in the sleeve with an insulating material therebetween.

11. The apparatus of claim 1 further comprising cooling means mounted in the sleeve to provide cooling for the camera.

12. The apparatus of claim 1 wherein the inner chamber is separated into a first inner chamber in communication with the atomizing gas orifice, and a second inner chamber below the first inner chamber in communication with the porthole means and the cylindrical sleeve, the first gas inlet extending through the plenum means in communication with the first chamber, and a second gas supply means extending through the plenum means in communication with the second chamber.

13. A viewing apparatus for liquid metal atomization comprising;

a nozzle for atomizing liquid metal comprised of a cylindrical plenum means, and a melt guide tube extending axially therethrough to a melt exit orifice, the plenum means defining an inner chamber coupled with an annular atomizing gas orifice spaced from the exit orifice and configured to provide an annular jet of atomizing gas converging in an atomizing zone extending from the exit orifice, a first gas inlet extending through the plenum means to provide atomizing gas to the inner chamber, the plenum means being comprised of an inner sidewall and an outer sidewall defining the inner chamber therebetween, the inner sidewall extending below the exit orifice so that the inner sidewall is spaced from the atomizing zone, a cylindrical sleeve extending through the outer sidewall to a first end in the inner chamber, the sleeve having a threaded outer surface mating with a threaded bore in the outer sidewall, a camera mounted in the sleeve having a field of view extending from the first end, and a transparent window mounted to seal the first end, the sleeve being positioned so the field of view extends through the atomization zone, and a porthole means having a first sleeve extending through the inner wall to a second end spaced from the transparent window, a disc mounted in the first sleeve, the disc having a bore that the field of view extends through to provide a view of the atomization zone to the camera, and for a gas flow therefrom.

14. The apparatus of claim 13 wherein the bore of the disc is 0.25 to 13 millimeters in diameter.

15. The apparatus of claim 13 wherein the bore of the disc is shaped as a frustrum having a narrow end facing the window.

16. The apparatus of claim 15 wherein the frustrum has an included angle of about 10 to 40 degrees.

17. The apparatus of claim 13 wherein the first sleeve is comprised of a first section extending through the inner wall to a first threaded end, and a second section having a second threaded end mating with the first threaded end, the second secton extending therefrom to the second end, wherein the second end is spaced a preselected distance from the transparent window to provide a gas flow throught the bore that minimizes passage of atomized particles to the window.

18. The apparatus of claim 14 wherein the inner chamber is separated into a first inner chamber in communication with the atomizing gas orifice, and a second inner chamber below the first inner chamber in communication with the porhole means and the cylindrical sleeve, the first gas inlet extending through the plenum means in communication with the first chamber, and a second gas supply means extending through the plenum means in communication with the second chamber.

19. A viewing apparatus for liquid metal atomization comprising;

a nozzle for atomizing liquid metal comprised of a first cylindrical plenum means, and a melt guide tube extending axially thererthrough to a melt exit orifice, the plenum means defining an inner chamber coupled with an annular atomizing gas orifice spaced from the exit orifice and configured to provide an annular jet of atomizing gas converging in an atomizing zone extending from the exit orifice, a first gas inlet extending through the plenum means in communication with the inner chamber, a second plenum means mounted below the first plenum means, the second plenum means being comprised of an inner sidewall and an outer sidewall defining a second inner chamber therebetween, the inner sidewall extending below the exit orifice so that the inner sidewall is spaced from the atomizing zone, a second gas inlet extending through the second plenum means in communication with the second inner chamber, a cylindrical sleeve extending through the outer sidewall to a first end in the second inner chamber, a camera mounted in the sleeve having a field of view extending from the first end, and a transparent window mounted to seal the first end, the sleeve being positioned so the field of view extends through the atomization zone, and a porthole means extending through the inner sidewall along the field of view to provide a view of the atomization zone to the camera, and for a gas flow therefrom.

20. The apparatus of claim 19 wherein the porthole means is comprised of a first sleeve extending through the inner sidewall to a second end spaced from the transparent window, and a disc mounted in the first sleeve, the disc having a bore that the field of view extends through.

21. The apparatus of claim 20 wherein the cylindrical sleeve has a threaded outer surface mating with a threaded bore in the outer sidewall.

22. The apparatus of claim 21 wherein the bore of the disc is about 0.25 to 13 millimeters in diameter.

23. The apparatus of claim 21 wherein the bore of the disc is shaped as a frustrum having a narrow end facing the window, the narrow end being about 0.25 to 13 millimeters in diameter.

24. The apparatus of claim 23 wherein the frustrum has an included angle of about 10 to 40 degrees.

25. The apparatus of claim 22 wherein the first sleeve is comprised of a first section extending through the inner wall to a first threaded end, and a second section having a second threaded end mating with the first threaded end, the second secton extending therefrom to the second end, wherein the second end is spaced a preselected distance from the transparent window to provide a gas flow through the bore that minimizes passage of atomized particles to the window.

* * * * *